US009044844B1

(12) United States Patent
Barnhart et al.

(10) Patent No.: US 9,044,844 B1
(45) Date of Patent: Jun. 2, 2015

(54) WHEEL WEIGHT PLIERS

(71) Applicant: U.W.T. Inc., Lexington, NC (US)

(72) Inventors: Russell B. Barnhart, Lexington, NC (US); Kim M. Barnhart, Lexington, NC (US)

(73) Assignee: U.W.T. Inc., Lexington, NC (US)

( * ) Notice: Subject to any disclaimer, the term of this patent is extended or adjusted under 35 U.S.C. 154(b) by 0 days.

(21) Appl. No.: 14/472,499

(22) Filed: Aug. 29, 2014

Related U.S. Application Data

(60) Provisional application No. 61/978,010, filed on Apr. 10, 2014.

(51) Int. Cl.
*B25B 27/00* (2006.01)
*B25B 7/02* (2006.01)
*B25B 7/22* (2006.01)

(52) U.S. Cl.
CPC ..... *B25B 27/0078* (2013.01); *B25B 7/02* (2013.01); *B25B 7/22* (2013.01)

(58) Field of Classification Search
CPC ..... B25B 27/0078; B25B 7/22; B25F 1/003; B25F 1/006
USPC ..... 7/100, 125, 137, 143, 158, 161; 81/19, 81/21; 157/1.3; 254/131
See application file for complete search history.

(56) References Cited

U.S. PATENT DOCUMENTS

| | | | | |
|---|---|---|---|---|
| 834,908 | A | 11/1906 | Hussey | |
| D58,663 | S | 8/1921 | Crampton | |
| 1,689,585 | A | 10/1928 | Haschart | |
| 2,274,126 | A | 2/1942 | Carrigan | |
| 2,314,145 | A | 3/1943 | Kalajian | |
| D155,929 | S | 11/1949 | Schildmeier | |
| D160,605 | S | 10/1950 | Iskyan | |
| D161,034 | S | 11/1950 | Marthinsen | |
| D163,533 | S | 6/1951 | Mills | |
| 2,604,914 | A * | 7/1952 | Kahlen | 81/19 |
| 2,883,153 | A | 4/1959 | Abbott | |
| D192,101 | S | 1/1962 | Brown, Jr. | |
| D192,721 | S | 5/1962 | Mills | |
| 3,152,391 | A | 10/1964 | Bjorn et al. | |
| D203,296 | S | 12/1965 | Quartararo | |
| D203,297 | S | 12/1965 | Quartararo | |
| 3,721,282 | A | 3/1973 | Hayes et al. | |

(Continued)

FOREIGN PATENT DOCUMENTS

WO 0218104 A1 3/2002

OTHER PUBLICATIONS

MYERS Tire Supply, catalog, 2007, p. 124.

(Continued)

*Primary Examiner* — Hadi Shakeri
(74) *Attorney, Agent, or Firm* — Jeffrey Watson; Balser & Grell IP Law

(57) ABSTRACT

Wheel weight pliers include a first member and a second member. The first member has a first handle at a first handle end and a wheel weight removal hook at a first jaw end. The second member has a second handle at a second handle end and a leverage at a second jaw end. The first member and the second member are pivotally connected together at a pivot point to operatively form pliers that provide a variable gap distance between the hook and the leverage. Whereby the wheel weight removal hook in combination with the leverage are adapted for removing wheel weights.

13 Claims, 3 Drawing Sheets

(56) References Cited

U.S. PATENT DOCUMENTS

| | | | | |
|---|---|---|---|---|
| 3,793,656 | A | 2/1974 | Songer et al. | |
| 3,852,839 | A | 12/1974 | Blessing | |
| 4,268,926 | A | 5/1981 | Roxton | |
| 4,393,908 | A | 7/1983 | Clay | |
| D271,372 | S | 11/1983 | Fortune | |
| D301,962 | S | 7/1989 | Huang | |
| 5,044,033 | A | 9/1991 | Fosberg | |
| 5,575,029 | A * | 11/1996 | Simpson | 7/137 |
| D377,745 | S | 2/1997 | Laun | |
| 5,743,285 | A | 4/1998 | Shalkevich | |
| D407,289 | S | 3/1999 | Swenson, Jr. | |
| D416,777 | S | 11/1999 | Swenson, Sr. | |
| D429,987 | S | 8/2000 | Hung | |
| 6,446,318 | B1 | 9/2002 | Foose | |
| 6,536,308 | B1 | 3/2003 | Thorne et al. | |
| 6,915,936 | B2 | 7/2005 | Estes | |
| D519,820 | S | 5/2006 | Newman et al. | |
| D586,642 | S | 2/2009 | Budacz, III | |
| D620,337 | S | 7/2010 | Nuttall et al. | |
| 8,468,630 | B2 | 6/2013 | Barnhart et al. | |
| 2004/0129388 | A1 * | 7/2004 | Brazil | 157/1.3 |
| 2005/0060860 | A1 | 3/2005 | Kang | |
| 2007/0017321 | A1 | 1/2007 | Doney | |
| 2011/0314614 | A1 * | 12/2011 | Barnhart et al. | 7/100 |

OTHER PUBLICATIONS

Non-Final Office Action dated Feb. 7, 2013 for U.S. Appl. No. 13/110,064.

Non-Final Office Action dated Aug. 15, 2014 for U.S. Appl. No. 13/645,920.

* cited by examiner

WHEEL WEIGHT PLIERS

CROSS-REFERENCE TO RELATED APPLICATIONS

To the full extent permitted by law, the present United States Non-provisional Patent Application hereby claims priority to and the full benefit of United States Provisional Application entitled "Wheel Weight Pliers," having assigned Ser. No. 61/978,010, filed on Apr. 10, 2014, incorporated herein by reference in its entirety.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The instant disclosure is directed toward tools for use on wheels like automobile wheels, and more specifically, tools for use with wheel weights utilized on wheels like automobile wheels.

2. Description of the Related Art

Every year millions of small weights are attached to tires by automotive technicians balancing them. Tire balance, also referred to as tire unbalance or imbalance, describes the distribution of mass within an automobile tire and/or the wheel to which it is attached. When the tire rotates, asymmetries of mass may cause the wheel to wobble. This wobbling can give rise to ride disturbances, usually vertical and lateral vibrations. It can also result in a wobbling of the steering. The ride disturbance due to unbalance usually increases with speed. Vehicle suspensions can be excited by tire unbalance forces when the speed of the wheel reaches a point that its rotating frequency equals the suspension's resonant frequency. Tires may be inspected in factories and repair shops by two methods: static balancers and dynamic balancers. Tires with high unbalance forces may typically be downgraded or rejected. When tires may be fitted to wheels at the point of sale, they may be measured again, and correction weights may be applied to counteract the combined effect of the tire and wheel unbalance.

Automotive technicians may reduce the wobble to an acceptable level when balancing the wheel by adding small weights to the inner and outer wheel rims. A wheel weight may be installed by the use of a wheel weight and/or clip that may secure the wheel weight to the edge of the wheel. A tool, like a hammer, may typically be used to hammer the wheel weight and/or clip down onto the wheel. To remove the wheel weight and/or clip a tool, similar to a pair of pliers or a screw driver, may typically be used to grasp and pinch or pry the wheel weight and/or clip to remove the wheel weight.

Traditionally, wheel weights have been made of lead. However, to reduce environmental concerns, steel and zinc weights are being used more frequently. These steel and zinc weights may be coated or non-coated. The coated weights may have a coating on them which has been discovered to chip or scratch during the installation or removal of the wheel weight by standard wheel weight tools. In addition to the problems with the wheel weight chipping or scratching during installation and removal, the actual wheels themselves or rims (or coatings on the wheels or rims) have been discovered to chip and or scratch around their edges during installation or removal of the wheel weight with standard wheel weight tools. As should be understood these chipped and/or scratched portions of the wheels and/or wheel weights may be undesirable for vehicle owners.

Another problem associated with removing wheel weights with traditional tools like pliers and/or screw drivers, may be the user pinching their fingers or hands. These injuries may be another huge issue that tire tech's are having, as the current plier designs may require users to forceably pinch the weight between the pliers jaws, which can easily slip causing pinched finger and hands. Furthermore, with clip only weights the pliers may have no weight body to put between the jaws to remove the weight. The tire technicians may currently be using something like a screw driver and hammer to remove these types of weights which can be very time consuming and may also cause rim scratching.

There are many different sizes and shapes of wheel weights and/or clips. The five major manufacturers that may be known to supply wheel weights in the US are IMI, Hennessy (BADA), JM Nault, Perfect Equipment, and Plumbco. Each manufacturer's weights may differ in where the hole is located on the "clip", as well as the style and size of said hole. Consequently, it has been discovered that the tire industry currently has many problems with wheel-weight removal due to the changes in design and material of wheel weights being produced, not to mention the number of different wheel weights on today's market. The tools used to remove wheel weights over the last 50 years have been mainly plier type removers and they are no longer sufficiently able to handle the challenges of removing all of the weights being sold and applied in today's market, including tires with curb rubber which adds additional challenges. This issue may only get worse with the current "phasing out" of lead weights, which will most likely be completely implemented throughout the U.S. in the near future. Additionally, rim damage due to the current tools scratching wheels and rims and the additional high cost of workman's comp claims filed due to injuries sustained by tire changer's (employee's) fingers and hands by using inadequate pliers type wheel weight removers.

As a result, there is clearly a need for a wheel weight removal tool that can accommodate many different size and shapes of wheel weights, including many different sized and shaped holes on the clips, that is fast and easy to operate, and reduces or eliminates scratching or pinching even on tires with curb rubber.

Current wheel weight pliers, even those that have some type of point used to engage the wheel weight hole may be improperly designed and sized to remove even, the majority, or all wheel weights. In addition, they may have a tendency to scratch rims and pinch the users fingers or hands when removing wheel weights. Furthermore, the engaging point on other current tools may be permanently affixed to the tool along with the cutter and crimper and when they chip or break it may make the tool un-usable for its intended purpose and the tool must be replaced, making them non economical.

As a result, there is clearly an unmet need for a new design of wheel weight pliers that has the ability to remove all current and future wheel weights from wheels fast, easy, safe and economical, and may reduce or prevent chips and/or scratches on the wheel weight and/or wheel. The instant disclosure may be designed to address at least one or all of these problems.

SUMMARY

Briefly described, in select embodiments, the present disclosure of wheel weight pliers may include a first member and a second member. The first member may have a first handle at a first handle end and a wheel weight removal hook at a first jaw end. The second member may have a second handle at a second handle end and a leverage at a second jaw end. The first member and the second member may be pivotally connected together at a pivot point to operatively form pliers that provide a variable gap distance between the hook and the leverage. Whereby, the wheel weight removal hook, in combination with the leverage, may be adapted for removing wheel weights.

One feature of the instant disclosure may be that the pliers may be adapted for removing a majority of wheel weights.

Another feature of the instant disclosure may be that the pliers may be adapted for removing all wheel weights.

One feature of the wheel weight removal hook may be that it can be made of steel being heat treated or hardened.

Another feature of the wheel weight removal hook may be that it can be replaceable. In one embodiment, the first member may have a plurality of holes approximate to the first jaw end adapted to attach the wheel weight removal hook. The plurality of holes in this embodiment may be threaded, whereby a plurality of screws may be used for attaching and replacing the wheel weight removal hook to the first jaw end in a fixed position or in a floating manner.

One feature of the leverage may be that it can have a replaceable rim protector cap. The replaceable rim protector cap may have a leverage face that provides the ability to apply the leverage to various positions where needed. In one embodiment, a steel tip may be included to attach the replaceable rim protector cap. Wherein, the replaceable rim protector cap of the leverage may be located on the second jaw end of the second member and may have an indention sized to receive the wheel weights. Whereby, the rim protector cap of the leverage, the wheel weight removal hook, and the variable gap distance between them, may provide the ability of the wheel weight pliers to remove all wheel weights.

In one embodiment, the first member may include an angle approximate to the pivot point and the second member may include a corresponding angle approximate to the pivot point. In select angled embodiments, the angle of the first and second members may be approximately 90 degrees. In select optional angled embodiments, the second member may further include a hammer head on the other end of the angled leverage. The hammer head may include a replaceable wheel weight protector cap, and a tip for attaching the replaceable wheel weight protector cap.

Another optional feature of the instant disclosure may be where the first member has a wheel weight cutter approximate to the wheel weight removal hook. In select embodiments the wheel weight cutter may be replaceable.

Another optional feature of the instant disclosure may be where the first member or the second member including a wheel weight crimper approximate to the handle. In select embodiments the wheel weight crimper may be replaceable.

Another feature of the wheel weight removal hook may be that it can include a tip point and a throat. The tip point may be adapted to be inserted in the hole of a wheel weight. The throat may be adapted to fit around the wheel weight. In select embodiments, the wheel weight removal hook may be made of a strong material capable of removing wheel weights, whereby, when the tip point is inserted into the hole of a wheel weight clip, where the leverage may be positioned against the wheel weight, the hook may be utilized for removing the wheel weight.

In select embodiments, the throat of the wheel weight removal hook may have a length. The length of the throat may be sized for allowing the tip point to be positioned inside the hole of the desired wheel weight.

Another feature of the wheel weight removal hook may be that it can include a fastening portion adapted to mount the hook on a tool like the instant wheel weight pliers. In select embodiments, the fastening portion may include a plurality of fastening holes.

These and other features of the wheel weight pliers will become more apparent to one skilled in the art from the prior Summary, and following Brief Description of the Drawings, Detailed Description, and Claims when read in light of the accompanying Detailed Drawings.

BRIEF DESCRIPTION OF THE DRAWINGS

The present wheel weight pliers will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Figure 1:
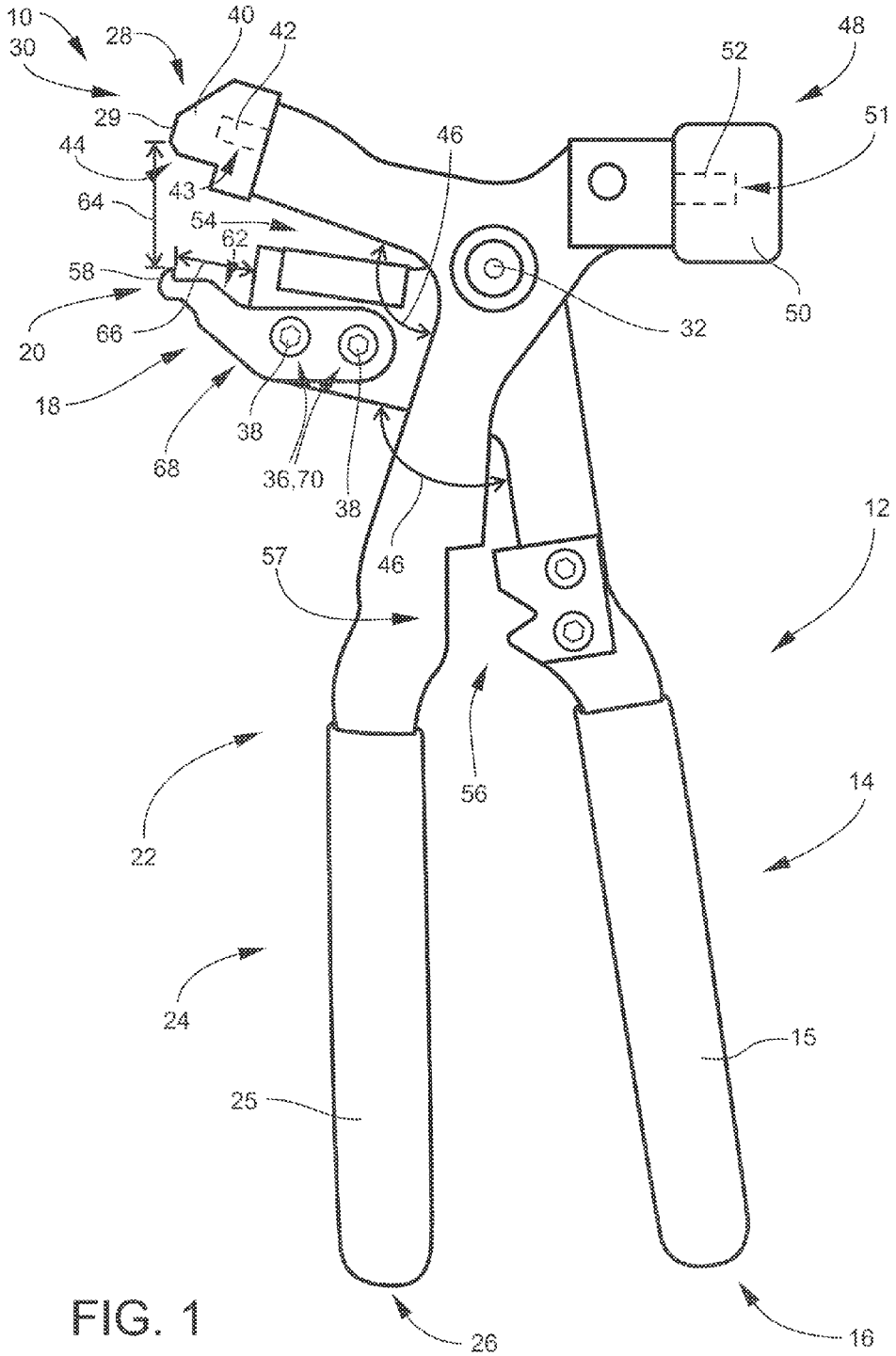
FIG. 1 is a front view of wheel weight pliers according to at least one example embodiment of the instant disclosure in an open position.
Figure 2:
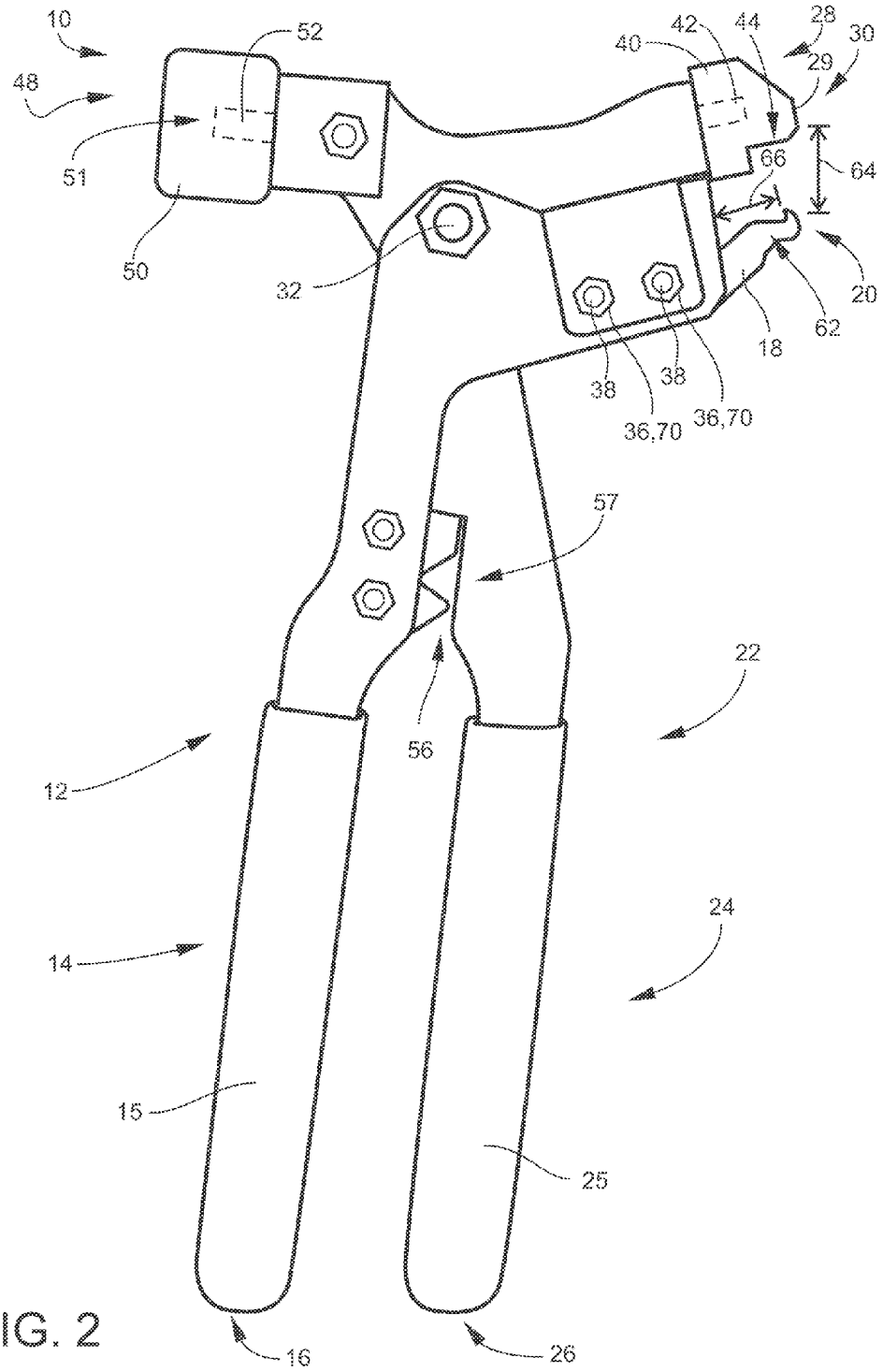
FIG. 2 is a rear view of the embodiment of FIG. 1 in a closed position.
Figure 3:
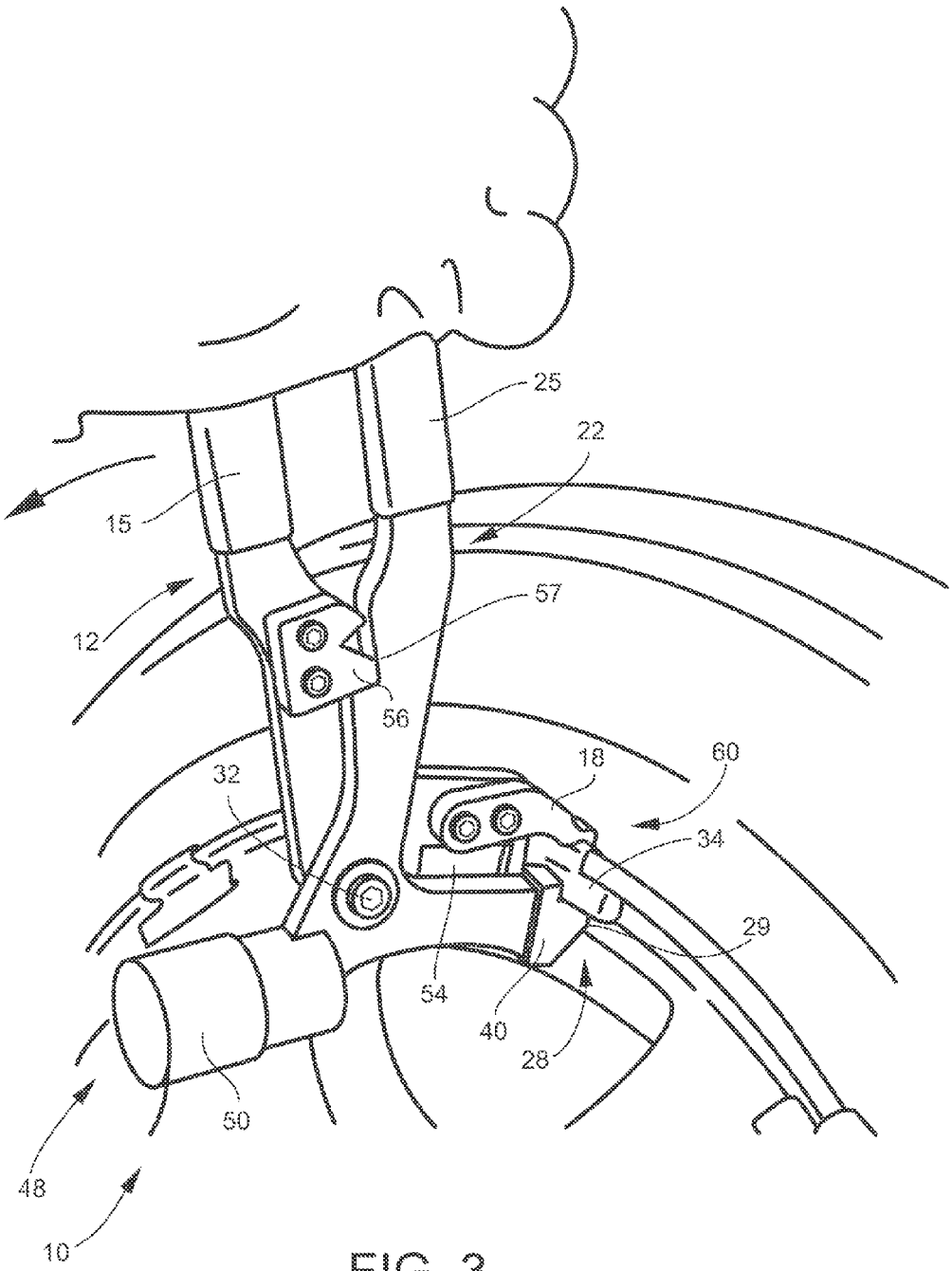
FIG. 3 is an environmental perspective view of the embodiment from FIG. 1 in use removing a wheel weight.

In describing the example embodiments of the present disclosure, as illustrated in FIGS. 1-3, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

The instant disclosure is directed toward wheel weight pliers. U.S. Pat. No. 8,468,630 and its continuation-in-part application, published as US 20130025102, both by the instant inventors/applicant, disclose a wheel weight installation and removal tool that is designed to address the problem associated with installing and removing wheel weights to reduce or prevent chips and/or scratches on the wheel weight and/or wheel itself. In addition, U.S. Design Pat. Nos. D661,959, and D673,433, also both by the same inventors/applicant, disclose various embodiments of wheel weight removal hooks for use on various wheel weight tools. The teachings of these patents and publications by the instant inventor/applicant are incorporated herein by reference. The instant disclosure may be a modification of the tools and hooks disclosed in such patents and publication into pliers form with some added features/benefits.

Referring now to FIGS. 1-3 by way of example, and not limitation, therein is illustrated an example embodiment of wheel weight pliers 10. Wheel weight pliers 10 may be for use by automobile technicians in installing and removing wheel weights from wheels like automobile wheels. However, the invention is not so limited, and wheel weight pliers 10 may be utilized for other purposes by automobile technicians and other mechanical uses outside of the automobile field. Wheel weight pliers 10 may generally comprise first member 12 and second member 22. First member 12 may have first handle 14 at first handle end 16. First member 12 may also have wheel weight removal hook 18 at first jaw end 20. Second member 22 may have second handle 24 at second handle end 26. Second member 22 may also have leverage 28 at second jaw end 30. First member 12 and second member 22 may be pivotally connected together at pivot point 32 to operatively form pliers 10. Pliers 10 may open and close to provide variable gap distance 64 between hook 18 and leverage 28. Whereby wheel weight removal hook 18 in combination with leverage 28 may be adapted for removing wheel weights 34. In one embodiment, wheel weight pliers 10 may be adapted for removing a majority of wheel weights 34. In another possibly preferred embodiment, wheel weight pliers 10 may be adapted for removing all wheel weights 34.

In order for wheel weight pliers 10 to remove a majority and/or all of wheel weights 34, variable gap distance 64 may be designed to fit the majority or all of wheel weights 34. Variable gap distance 64 may make room between tip point 58 of hook 18 and the bottom of leverage or rim protector cap 40 to accommodate the width of wheel weight 34 so the rim protector cap 40 sits on the outside of the weight 34 near the wheel rim when hook 18 is inserted into hole 60 of wheel weight 34. See FIG. 3. As such, variable gap distance 64 may provide a stop distance or permanent opening (see FIG. 2) to a maximum distance or opening (see FIG. 1). The stop distance or permanent opening may be the gap distance 64 required for the smallest wheel weights 34. The maximum distance or opening (see FIG. 1) may be the gap distance 64 required for the largest wheel weights 34. For example, in one embodiment, the variable gap distance 64 may be provided with a stop distance or permanent opening of ⅜ inches to a maximum distance or opening of 1.5 inches (or greater). This example range of variable gap distance 64 from ⅜ inches to 1.5 inches may accommodate all of the wheel weights on the market today. However, pliers 10 may be designed with larger or smaller variable gap distance 64 to accommodate any future wheel weight designs and sizes.

Wheel weight removal hook 18 may be included in wheel weight pliers 10. Wheel weight removal hook 18 may be for removing wheel weights 34. Wheel weight removal hook 18 may be sized and shaped to remove wheel weights 34, including a majority and/or all of wheel weights 34. The hook 18 or hooks used on the instant disclosure may be made of any material strong enough to remove wheel weights 34. Wheel weight removal hook 18 may be made from a material capable of removing wheel weights 34, including a majority and/or all of wheel weights 34. The wheel weight removal hook 18 may be made out of any desirable material, including, but not limited to, being made of steel. In one embodiment, the wheel weight removal hook 18 may be made out of heat treated steel, or hardened steel, to insure proper strength. In one embodiment, wheel weight removal hook 18 may be integrally made with pliers 10. In another possibly preferred embodiment, wheel weight removal hook 18 may be replaceable, or removably attached to first jaw end 20 of first member 12. In this replaceable embodiment, wheel weight removal hook 18 may be removably attached by any means. In one embodiment, first member 12 may have a plurality of holes 36 approximate to first jaw end 20 adapted to attach wheel weight removal hook 18. In this embodiment, the plurality of holes (including, but not limited to, two (2) holes 36 as shown in the Figures), may be threaded whereby a corresponding plurality of screws 38 may be used for attaching and replacing wheel weight removal hook 18 to said first jaw end 20. In select embodiments, as shown in the Figures, wheel weight removal hook 18 may be attached to first member 12 in a fixed position where wheel weight removal hook is not adjustable. In other select embodiments, wheel weight removal hook 18 may be attached to first member 12 in a floating manner thereby allowing hook 18 to move its leverage point to adapt to wheel weight 34, including a majority and/or all of wheel weights 34. In this floating embodiment, hook 18 may move forward/backward, up/down, rotate, or various combinations thereof to adapt to various sized and/or shaped wheel weights 34, whether known and used now or developed in the future.

Wheel weight removal hook 18 may be sized according to the desired wheel weights 34 it will be used on, or it may be preferably sized to fit a majority or all of wheel weights. In one embodiment, weight removal hook 18 may be similar to the hook disclosed in U.S. Design Pat. No. D661,959. In another embodiment, wheel weight removal hook 18 may be similar to the hook disclosed in U.S. Design Pat. No. D673,433.

Leverage 28 may be included in wheel weight pliers 10. Leverage 28 may be for providing a leverage point or surface for wheel weight removal hook 18 to aid in removing wheel weights 34. Leverage 28 may be any size, shape or style of device for providing a leverage point or surface for wheel weight removal hook 18. In one embodiment, leverage 28 may have replaceable rim protector cap 40 with leverage face 29. Replaceable rim protector cap 40 with leverage face 29 may provide the ability to apply the leverage to various positions where needed while protecting the rim and/or other desired areas from chipping, scratching, etc. Replaceable rim protector cap 40 of leverage 28 may be located on second jaw end 30 of second member 22. In one embodiment, rim protector cap 40 may be integrally formed on second jaw end 30 of second member 22. In another possibly preferred embodiment, rim protector cap 40 may be replaceable, or removably attached to second jaw end 30 of second member 22. This replaceable embodiment may allow for rim protector cap 40 to be removed and replaced when damaged, torn, warn, the like, etc. Rim protector cap 40 may be replaceable by any means. In one embodiment, leverage tip 42 may be included to attach replaceable rim protector cap 40 to second jaw end 30 of second member 22, where replaceable rim protector cap 40 includes slot or cap hole 43 whereby leverage tip 42 may be inserted inside the slot or cap hole 43 for attaching replaceable rim protector cap 40 to leverage tip 42. In one embodiment, rim protector cap 40 may include cap hole 43 adapted to be inserted onto leverage tip 42. Leverage tip 42 may be protruding from second jaw end 30 of second member 22. In this embodiment, cap hole 43 may be dimensioned slightly smaller than leverage tip 42, whereby, frictional forces may maintain rim protector cap 40 on second member 22. Replaceable rim protector cap 40 may be sized to fit around wheel weights 34, including a majority and/or all of wheel weights 34 and/or may be sized to help aid the positioning of leverage 28 adjacent to wheel weight 34 on the rim or wheel. In one embodiment, replaceable rim protector cap 40 may include indention 44 sized to receive wheel weights 34, including a majority and/or all of wheel weights 34. Indention 44 may be adapted fit around wheel weights 34, including a majority and/or all of wheel weights 34 and/or may be to help aid the positioning of leverage 28 adjacent to wheel weight 34 on the rim or wheel. Rim protector cap 40 may be made of any desired material for reducing and/or preventing scratches, chips, etc. on the wheels, rims, etc. In on embodiment, rim protector cap 40 may be made of nylon.

Wheel weight removal hook 18, in combination with rim leverage 28 (with rim protector cap 40 and leverage face 29) may provide the ability of wheel weight pliers 10 to remove wheel weights 34, including a majority and/or all of wheel weights 34. As such, pliers 10 may be designed where first and second jaw ends 20 and 30 may be opened wide enough to accommodate any size or shape wheel weights 34 and/or clips between wheel weight removal hook 18 and leverage 28.

In one embodiment, the first and second handles 14 and 24 may include grips 15 and 25, respectively. For example, first grip 15 and/or second grip 25 may be handle pocket grips.

Angle 46 may be included in select embodiments of wheel weight pliers 10. Angle 46 may be for providing an angle between handles 14 and 24 and jaw ends 20 and 30. Angle 46 may include first member 12 having angle 46 approximate to pivot point 32 and second member 22 having a corresponding angle 46 approximate to pivot point 32. Pliers 10 may be provided with any desired angle 46 between handles 14 and 24 and jaw ends 20 and 30. In one embodiment, angle 46 may be approximately ninety (90) degrees. Angle 46 may be adapted for allowing better leverage and grip of pliers 10. In addition, providing pliers 10 with angle 46 may allow for the inclusion of hammer head 48 on the other end of the angled leverage 28.

Hammer head 48 may be attached to the other end of the angled leverage 28 on second member 22. Hammer head 48 may be for providing a hammer head with pliers 10. Hammer head 48 may be any desired shape or size of a hammer head. Hammer head 48 may have replaceable wheel weight protector cap 50. For example, hammer head 48 may be for hammering a wheel weight onto a wheel utilizing wheel weight protector cap 50. Replaceable wheel weight protector cap 50 may be for providing a soft hammering surface, i.e., a hammering surface that will not chip or scratch metal and alloy surfaces. Replaceable wheel weight protector cap 50 may be any type of soft hammering surface. Replaceable wheel weight protector cap 50 may be made out of any desirable material. In select embodiments, wheel weight protector cap 50 may be made of any soft material, including, but not limited to, being made of nylon. Hammer head 48 may be attached to the other end of the angled leverage 28 on second member 22 by any means. Wheel weight protector cap 50 may be integrally built onto hammer head 48 or it may be removable. Having wheel weight protector cap 50 removable from hammer head 48 may allow wheel weight protector cap 50 to be replaceable when it becomes damages, warn, torn, etc. The removable wheel weight protector cap 50 may be attached to hammer head 48 by any means. In one embodiment, as shown in the Figures, wheel weight protector cap 50 may include a cap hole 51 adapted to be inserted onto hammer tip 52. Hammer tip 52 may be protruding from the other end of the angled leverage 28 on second member 22. In this embodiment, cap hole 51 may be dimensioned slightly smaller than hammer tip 52, whereby, frictional forces may maintain wheel weight protector cap 50 on hammer head 48.

Wheel weight cutter 54 may optionally be included with wheel weight pliers 10. Wheel weight cutter 54 may be for cutting wheel weights 34 or other desired objects and/or materials. Wheel weight cutter 54 may be on first member 12 approximate to wheel weight removal hook 18. In one embodiment, wheel weight cutter 54 may be integrally formed on first member 12. In another embodiment, wheel weight cutter 54 may be replaceable, or removably attached to first member 12.

Wheel weight crimper 56 may optionally be included with wheel weight pliers 10. Wheel weight crimper 56 may be for crimping or compressing into small folds or ridges wheel weights 34 or other desired objects and/or materials. Wheel weight crimper 56 may be on first member 12 or second member 22 approximate to first handle 14 or second handle 24. In one embodiment, wheel weight crimper 56 may be integrally formed on first member 12 or second member 22. In another embodiment, wheel weight crimper 56 may be replaceable, or removably attached to first member 12 or second member 22.

Stop 57 may optionally be included with wheel weight pliers 10. Stop 57 may be for keeping pliers 10 from closing beyond a certain point of variable gap distance 64, like to avoid pinching fingers, hands, the like, etc. when using pliers 10. Stop 57 may be on first member 12 or second member 22 approximate or above first handle 14 or second handle 24. In one embodiment, stop 57 may be formed as a part of wheel weight crimper 56. Stop 57 may set the stop distance or permanent opening of variable gap distance 64 required for the smallest wheel weights 34.

Wheel weight removal hook 18 may be shaped and sized for removing wheel weights 34, including a majority and/or all of wheel weights 34. In one embodiment, as shown in the Figures, wheel weight removal hook may include tip point 58 and throat 62. Tip point 58 may be adapted to be inserted in the hole 60 of wheel weight 34, including a majority and/or all of wheel weights 34. Throat 62 may be adapted to fit around wheel weight 34, including a majority and/or all of wheel weights 34. When tip point 58 may be inserted into hole 60 of wheel weight 34, which may or may not include a clip, where leverage 28 may be positioned against wheel weight 34, pliers 10 may be utilized for removing wheel weight 34. Throat 62 may include length 66. Length 66 of throat 62 may be sized for allowing tip point 58 to be positioned inside hole 60 of the desired wheel weight 34. In an example embodiment, throat length 66 may be approximately ¾ inches.

Wheel weight hook 18 may optionally include fastening portion 68. Fastening portion 68 may be for providing an area on wheel weight hook 18 for attaching the hook to pliers 10 or other desired devices. Fastening portion 68 may be adapted to mount hook 18 on a tool like wheel weight pliers 10. Fastening portion 68 may allow for wheel weight hook 18 to be replaceable, or removably attached to pliers 10. In one embodiment, fastening portion 68 may include a plurality of fastening holes 70 for removably attaching hook 18 to a desired tool, including, but not limited to, wheel weight pliers 10. As shown in the embodiment of FIGS. 1-3, plurality of screws 38 may be inserted through fastening holes 70 and tightened to threaded holes 36 of first member 12 for securing fastening portion 68 of hook 18 to pliers 10.

Referring to the embodiment shown in FIGS. 1-3, wheel weight pliers 10 may generally include a hammer head 48 with replaceable or permanent wheel weight removal metal hook 18 and leverage 28. Wheel weight pliers 10 may have a main body with first member 12 and second member 22. In select embodiments, the main body may be made of steel, and may be coated for rust protection. The main body may include two members (12 and 22) which are affixed together with a screw or rivet at pivot point 32. One member of the main head portion of the tool may include a steel hammer head 48 extension with a steel hammer tip 52 to secure protective cap 50. Affixed to the hammer head 48 extension may be a replaceable or permanent custom designed plastic protective cap 50 that contains a threaded hole to fit over the extension stud. This cap 50 may be used to protect coated wheel weights when being applied to a wheel. Opposite hammer head 48, the jaw portion of pliers 10 may contain two parts, the first of which contains a steel leverage tip 42 that may secure leverage 28 and rim protector cap 40. The replaceable or permanent leverage 28 may contain a cap hole 43 which may assist to secure cap 40 to the mounting stud, or steel leverage tip 42. The second portion of the jaw may contain a specific location where metal coated wheel weight removal hook 18 may be attached, like via two metal screws 38 which may be placed into fastening holes 70 and tightened down into holes 36. In addition to hook 18, the second portion of the jaw may also contain a permanent or replaceable steel coated wheel weight cutter 54 blade attachment. The mid handle portion of pliers 10 may contain a permanent or replaceable coated steel wheel weight crimping tool 56 and stop 57 attachment.

One feature of the instant disclosure may be the steel handle portions of the tool may be covered with grips 15 and 25 for comfort and protection.

In use, to apply wheel weights 34, a user may hold the tool by the handle portion (first handle 14 and/or second handle 24) of pliers 10 and then strike the covered hammer head 48 against the clip and body of wheel weight 34 being attached to a wheel rim until tight.

Referring now to FIG. 3, in use, to remove wheel weight 34, a user may insert tip point 58 of hook 18, on the jaw end of the tool, into the hole 60 on the clip or the wheel weight 34 itself, this creates a secure traction point. Then, rest the leverage face 29 of rim protector cap 40 from leverage 28, located on the jaw portion of the tool opposite the removal hook 18, against the bottom of the wheel weight body, or if the wheel weight 34 has no body on the back side of the clip, then optionally squeeze the handles (14 and 24) of pliers 10 together. This optional pressure may engage the two head pieces of the pliers together and may further secure the hook 18 to wheel weight 34. Once the hook 18 is engaged in hole 60 and leverage 28 is properly positioned, wheel weight pliers 10 may be pulled forward or rotated toward the inside of the wheel for easy removal of wheel weight 34.

One unique feature may be the incorporation of an innovative, specially designed replaceable hook 18 that is correctly sized and may be made of hardened metal to insure the strength need to remove wheel weights applied with increased tension, which hook 18 may be affixed or attached into a specific location on the pliers 10.

Another unique feature may be that the tip point 58 of the heavy duty hook 18 may be fitted onto a specific location on one part of the pliers jaw to be placed into the hole 60 located on the wheel weight 34 itself. This feature may create a strong traction point which significantly reduces the possibility of slippage or pinching fingers and hands.

Another unique feature may be, opposite the hook 18 location, the second portion of the tool pliers jaw may be fitted with a unique replaceable leverage 28 engaging point/surface with rim protector cap 40. This specially designed leverage 28 with cap 40 may make it possible to adjust the pliers jaw to the specific location needed on each individual clip style wheel weight to insure the force necessary for easy wheel weight removal without scratching the wheel.

Another unique feature may be, due to the innovative leverage 28 with cap 40 and removal hook 18 working together and the handle design of pliers 10 with a stop feature, the instant disclosure may make it possible to adjust the leverage point/surface to remove all clip and/or clipless style wheel weights fast and easy.

Yet another unique feature may be the inclusion of a replaceable wheel weight crimper 56, a replaceable cutter 54, and hammer head 48 with replaceable protector cap 50. In addition to the replaceable hook 18 and replaceable leverage cap 40 described above, these replaceable features may make the instant disclosure very economical should the parts wear, chip or break over time.

The instant disclosure may include numerous benefits or additions over current wheel weight tools. These benefits/additions may include, but are not limited to: being a combination wheel weight pliers and hammer with specially designed replaceable wheel weight removal hook; the pliers jaw may include a replaceable leverage engaging point/surface and/or wheel protector cap; the pliers may include replaceable wheel weight cutter and/or wheel weight crimper options; the wheel weight pliers and hammer may include specially designed replaceable wheel weight removal hook or hooks where hook engaging point inserted into wheel weight hole may significantly reduce the possibility of slippage when removing clip style wheel weights; the pliers jaw may include a replaceable leverage engaging point/surface and/or wheel protector cap that may be designed to work together with removal hook to insure adjustable force at different locations to remove all or a majority of wheel weights and may eliminate the possibility of scratching wheel rims; special unique design of pliers handle with stop, along with hook traction in wheel weight hole may significantly reduce the possibility of a user pinching his or her finger or hands when removing wheel weights; the pliers may be economical with replaceable parts including: removal hook, leverage and/or wheel protector cap, hammer head protector cap, cutter and/or crimper; other non listed benefits/advantages; the like; or combinations thereof.

The foregoing description and drawings comprise illustrative embodiments. Having thus described example embodiments, it should be noted by those skilled in the art that the within disclosures are example only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. Wheel weight pliers comprising:

a first member having a first handle at a first handle end and a wheel weight removal hook at a first jaw end, said hook having a tip point, said tip point having an inner surface; and a second member having a second handle at a second handle end and a leverage at a second jaw end, said leverage having a rim protector cap with a leverage face, wherein said leverage face being approximately parallel to said inner surface;

wherein, said first member and said second member being pivotally connected together at a pivot point to operatively form the wheel weight pliers that provide a variable gap distance between said hook and said leverage;

whereby said wheel weight removal hook in combination with said leverage being operative for removing wheel weights from a wheel by engaging the tip point of hook with the wheel weight for a secure traction with the inner surface, and resting the leverage face against the wheel or a portion of the wheel weight.

2. The wheel weight pliers of claim 1 being adapted for removing a plurality of wheel weights.

3. The wheel weight pliers of claim 1 wherein said variable gap distance being from ⅜ inches to 1.5 inches.

4. The wheel weight pliers of claim 1 wherein said wheel weight removal hook being made of steel being heat treated or hardened.

5. The wheel weight pliers of claim 1 wherein said wheel weight removal hook being replaceable.

6. The wheel weight pliers of claim 5 wherein said first member having a plurality of holes approximate to said first jaw end for attaching said wheel weight removal hook;

wherein said plurality of holes being threaded;

whereby a plurality of screws may be used for attaching and replacing said wheel weight removal hook to said first jaw end in a fixed position or in a floating manner.

7. The wheel weight pliers of claim 1 wherein said leverage having:

a replaceable rim protector cap with said leverage face for applying the leverage to various positions where needed; and a leverage tip to attach said replaceable rim protector cap;

wherein the replaceable rim protector cap of said leverage being located on said second jaw end of the second member and having an indention sized to receive the wheel weights;

whereby the rim protector cap of said leverage, in combination with the wheel weight removal hook, providing the ability of the wheel weight pliers to remove a plurality of wheel weights.

8. The wheel weight pliers of claim 1 wherein said first member including an angle approximate to said pivot point and said second member including the corresponding said angle approximate to said pivot point;

wherein said angle of said first and second members being approximately 90 degrees.

9. The wheel weight pliers of claim 8 wherein said second member further including a hammer head on the other end of the angled leverage, said hammer head including:

a replaceable wheel weight protector cap; and a hammer tip for attaching said replaceable wheel weight protector cap.

10. The wheel weight pliers of claim 1 wherein:

said first member including a wheel weight cutter approximate to said wheel weight removal hook;

said first member or said second member including a wheel weight crimper approximate to said handle; and said first member or said second member including a stop to keep the pliers from closing beyond said variable gap between said hook and said leverage;

wherein said wheel weight cutter being replaceable, and/or said wheel weight crimper being replaceable.

11. The wheel weight pliers of claim 1 wherein said wheel weight removal hook comprising:

a tip point being sized to be inserted in a hole of a wheel weight;

and a throat being sized to fit around the wheel weight;

wherein said hook being insertable in the hole of the wheel weight.

12. The wheel weight pliers of claim 11 wherein: said throat having:

a length being sized for allowing the tip point to be positioned inside the hole of the wheel weight.

13. The wheel weight pliers of claim 12 wherein said throat length being approximately ¾ inches.

* * * * *